US008322999B2

(12) United States Patent
Bergmann

(10) Patent No.: US 8,322,999 B2
(45) Date of Patent: Dec. 4, 2012

(54) HYDROSTATIC AXIAL PISTON MACHINE

(75) Inventor: Martin Bergmann, Schaafheim (DE)

(73) Assignee: Linde Material Handling GmbH, Aschaffenburg (DE)

( * ) Notice: Subject to any disclaimer, the term of this patent is extended or adjusted under 35 U.S.C. 154(b) by 883 days.

(21) Appl. No.: 12/239,953

(22) Filed: Sep. 29, 2008

(65) Prior Publication Data

US 2009/0095148 A1 Apr. 16, 2009

(30) Foreign Application Priority Data

Oct. 15, 2007 (DE) ..... 10 2007 049 401

(51) Int. Cl.
*F04B 1/12* (2006.01)
*F04B 27/08* (2006.01)

(52) U.S. Cl. ..... 417/269; 417/270; 417/271; 92/12.2; 92/57

(58) Field of Classification Search ..... 417/269–271; 92/55–57, 71, 12.2, 13; 91/499, 197
See application file for complete search history.

(56) References Cited

U.S. PATENT DOCUMENTS

| | | | | |
|---|---|---|---|---|
| 3,143,858 | A * | 8/1964 | Roeske | 60/468 |
| 3,257,960 | A * | 6/1966 | Keel | 417/269 |
| 4,007,663 | A * | 2/1977 | Nagatomo et al. | 91/6.5 |
| 4,896,564 | A * | 1/1990 | Eickmann | 475/73 |
| 5,085,127 | A * | 2/1992 | Gantzer | 91/499 |
| 5,983,781 | A * | 11/1999 | Ivantysyn | 92/71 |
| 6,293,763 | B1 * | 9/2001 | Yokomachi et al. | 417/269 |
| 6,318,972 | B1 * | 11/2001 | Huang et al. | 417/269 |

FOREIGN PATENT DOCUMENTS

DE 43 40 061 A1 6/1995

* cited by examiner

*Primary Examiner* — Charles Freay
*Assistant Examiner* — Christopher Bobish
(74) *Attorney, Agent, or Firm* — The Webb Law Firm

(57) ABSTRACT

A hydrostatic axial piston machine, in particular a swashplate machine, has a cylinder drum (3) mounted so that it can rotate around an axis of rotation (2). The cylinder drum (3) is provided with cylinder bores (4), in each of which a piston (5) is mounted so that it can be displaced longitudinally. The cylinder drum (3) is axially supported on a control surface (8) affixed to the casing and on which an inlet connection (10) and an outlet connection (11) are realized. The cylinder bores (4) can each be placed in communication by a connecting channel (12) with the control surface (8). The connecting channel (12) is provided with a cross-section that increases from the cylinder bore (4) toward the control surface (8).

11 Claims, 8 Drawing Sheets

HYDROSTATIC AXIAL PISTON MACHINE

CROSS REFERENCE TO RELATED APPLICATIONS

This application claims priority to German application DE 10 2007 049 401.9, filed Oct. 15, 2007, which is herein incorporated by reference in its entirety.

BACKGROUND OF THE INVENTION

1. Field of the Invention

This invention relates to an axial piston machine, such as a swashplate machine, with a cylinder drum that is mounted so that it can rotate around an axis of rotation. The cylinder drum is provided with cylinder bores, in each of which a piston is mounted so that it can be displaced longitudinally. The cylinder drum is axially supported on a control surface that is affixed to the casing, on which control surface an inlet connection and an outlet connection are provided. The cylinder bores can each be brought into communication with the control surface by a connecting channel.

2. Technical Considerations

A generic axial piston machine utilizing a swashplate design is described in DE 43 40 061 A1, herein incorporated by reference. On axial piston machines of this type, a gap is necessary between the rotating cylinder drum and the control surface that is affixed to the casing. In the control surface, there are kidney-shaped control channels which form an inlet connection and an outlet connection of the axial piston machine. At the gap, a hydrostatic lubricating film is provided to reduce the friction between the hydrostatic friction bearing fouled by the cylinder drum and the control surface.

The cylinder drum is pressed toward the control surface by a piston force. This pressing piston force is produced by the pressure present in the cylinder bore and a pressurized surface which is formed because the cross-section of the connecting channel is smaller than the cross-section of the cylinder bore. This pressing piston force counteracts a hydrostatic compressive force which is present in the gap between the cylinder drum and the control surface. The hydrostatic compression force is formed from the pressure present in the gap and a sealing web that is formed on the end surface of the cylinder drum that faces the control surface.

The excess of force between the pressing piston force and the relieving hydrostatic compression force must thereby be designed so that, on one hand, when the gap width increases, a lifting of the cylinder drum and thus a higher leakage flow at the gap can be prevented and, on the other hand, so that excessive friction forces do not occur between the cylinder drum and the control surface and cause wear when the gap width is too small.

However, particularly when the cylinder bore is reversed from the inlet connection to the outlet connection at top and bottom dead center (and thus reversed from low pressure to high pressure or from high pressure to low pressure), the hydrostatic pressure force is subjected to disturbance effects which, in practice, are counteracted by an increase in the piston force applied and thus a high transfer of force between the pressing piston force and the relieving compressive force. This high transmission of force, however, leads to an increase of friction between the cylinder drum and control surface and thus a reduction in efficiency as well as an increase in the wear of the axial piston machine. Therefore, it is an object of this invention to provide a hydrostatic axial piston machine of the general type described above but which is characterized by increased efficiency and reduced wear.

SUMMARY OF THE INVENTION

The invention accomplishes this object by providing the connecting channel with a cross-section that increases from the cylinder bore toward the control surface. The invention therefore teaches that the opening of the connecting channel becomes larger toward the control surface. As a result of which, the surface area of the sealing web is reduced. As a result of this reduction of the surface area of the sealing web, the disturbance effects of the hydrostatic compressive force that occur during the reversal at top and bottom dead center are reduced. As a result of the reduction of the disturbance effects in an axial piston machine of the invention, the pressing piston force and the relieving compressive force are in a more constant ratio to each other. As a result, the excess of the pressing piston force over the relieving compressive pressure force can be reduced. It therefore becomes possible to reduce the friction between the cylinder drum and the control surface and to reduce leakage at the gap between the cylinder drum and the control surface. As a result, the efficiency of the axial piston machine of the invention is improved. The wear of the axial piston machine between the cylinder drum and the control surface is also reduced. As a result, less wear-resistant and more economical materials can be used for the cylinder drum and the control surface which form a hydrostatic friction bearing.

In one embodiment of the invention, the connecting channel is in communication by means of a first cross-section with the cylinder bore and by a second cross-section with the control surface, with the second cross-sectional area being larger than the first cross-sectional area. A connecting channel of this type which has different cross-sectional areas can easily be manufactured.

It is particularly advantageous if the second cross-sectional area is in the form of a depression of the connecting channel on the end surface of the cylinder drum facing the control surface. It thereby becomes possible, in the cylinder-bore side area of the connecting channels, to preserve a minimum width of a connecting web between neighboring connecting channels of the cylinder drum, which is advantageous for strength reasons.

In one embodiment of the invention, the first cross-sectional area and/or the second cross-sectional area can be in the shape of a circular ring.

In an additional exemplary embodiment of the invention, it is particularly advantageous if the first cross-sectional area and/or the second cross-sectional area are kidney-shaped. With a kidney-shaped cross-sectional area, it is possible to easily widen the opening of the connecting channel toward the control surface and thus to reduce the sealing web surface to reduce disturbance effects.

In terms of keeping the required design and construction effort low, it is advantageous if the first cross-sectional area is in the shape of a circular ring and the second cross-sectional area is kidney-shaped.

The second cross-sectional area advantageously has a kidney-shaped cross-section, whereby the width of the second cross-sectional area is essentially equal to the width of the first kidney-shaped cross-sectional area or the diameter of the first circular ring-shaped cross-section and the length of the second cross-sectional area is greater than the length of the first kidney-shaped cross-section or the diameter of the first circular ring-shaped cross-section.

In an additional advantageous embodiment of the invention, the transition from the first cross-sectional area to the second cross-sectional area is stepped.

Erosion wear caused by the flow of hydraulic fluid at the transition from the first cross-sectional area to the second cross-sectional area of the connecting channel can easily be prevented if, as in a second exemplary embodiment of the invention, the transition from the first cross-sectional area to the second cross-sectional area is continuous.

In an additional exemplary embodiment of the invention, the transition from the first cross-sectional area to the second cross-sectional area can be made tapered or inclined. With an inclined and thus funnel-shaped transition, it is easily possible to create a continuous transition.

In an additional exemplary embodiment of the invention, the transition from the first cross-sectional area to the second cross-sectional area can be convex, as a result of which it becomes possible to achieve a gentle continuous transition and to effectively prevent wear by erosion.

Additional advantages and details of the invention are explained in greater detail below with reference to the exemplary embodiments illustrated in the accompanying schematic drawings, wherein like reference numbers identify like parts throughout.

DESCRIPTION OF THE PREFERRED EMBODIMENTS

Figure 1:
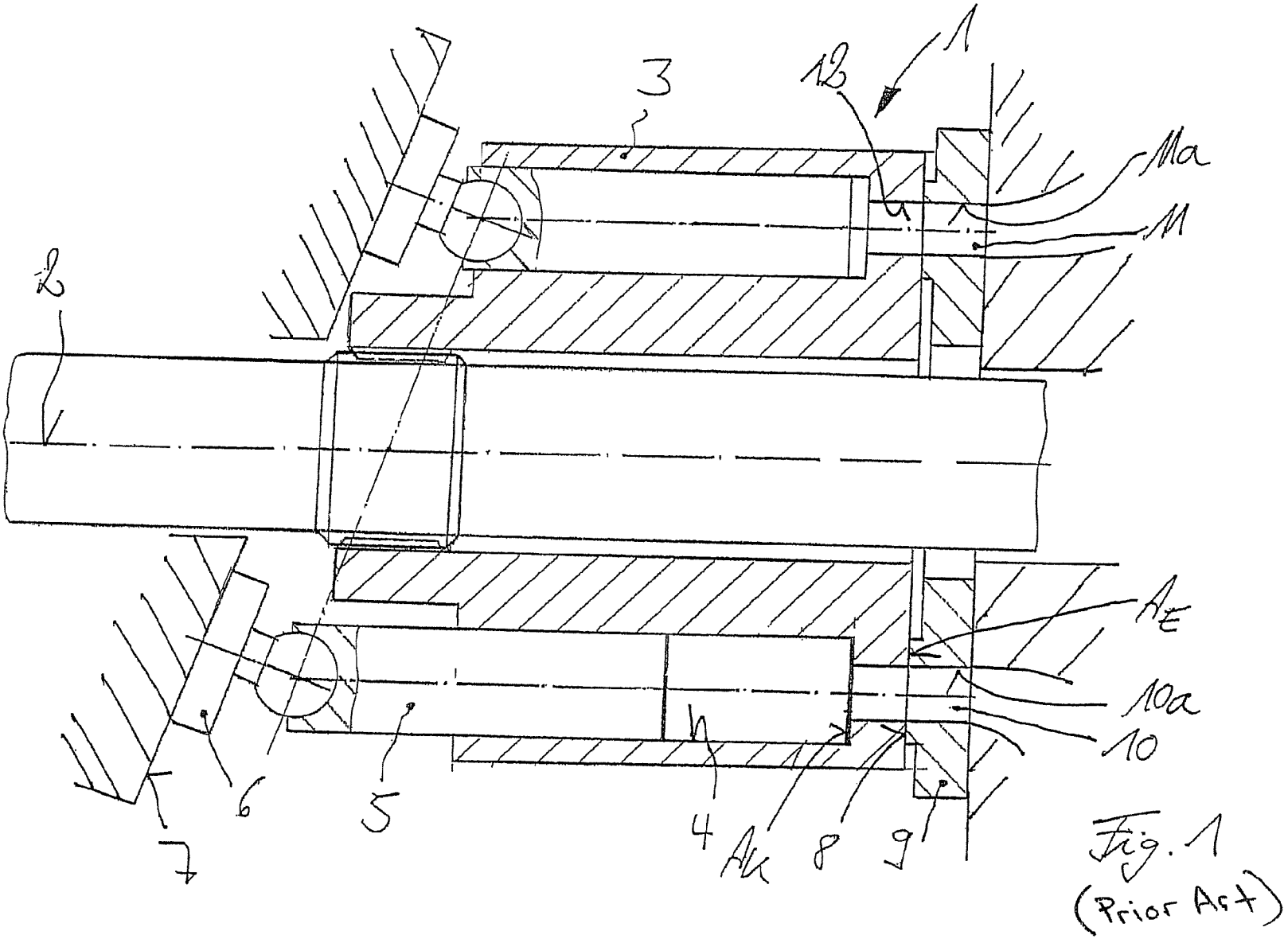
Fig. 1 (Prior Art)
FIG. 1 shows a longitudinal section of an axial piston machine of the prior art.

FIG. 1 shows a longitudinal section through a hydrostatic piston machine 1 of the prior art which is realized by way of example in the form of a swashplate machine.

The axial piston machine 1 has a cylinder drum 3 which is mounted so that it can rotate around an axis of rotation 2 and is provided with a plurality of concentrically arranged cylinder bores 4, in each of which a piston 5 is mounted so that it can move longitudinally.

The pistons 5 are thereby each supported by means of a sliding shoe 6 on a swashplate 7. The swashplate 7 can be molded onto a casing (not shown), whereby the axial piston machine 1 has a fixed displacement volume. It is also possible, however, to make the swashplate adjustable, as a result of which the axial piston machine has a variable displacement volume.

The cylinder drum 3 is supported in the axial direction on a control surface 8 which is affixed to the housing and is realized on a disc-shaped control plate 9. The control plate 9 is provided with kidney-shaped control slots 10*a*, 11*a*, which form an inlet connection 10 and an outlet connection 11 of the axial piston machine 1. The cylinder drum 3 is provided for each cylinder bore 4 with a connecting channel 12 which, when the cylinder drum 3 rotates, makes possible a connection between the cylinder bore 4 and the inlet connection 10 as well as with the outlet connection 11.

Figure 2:
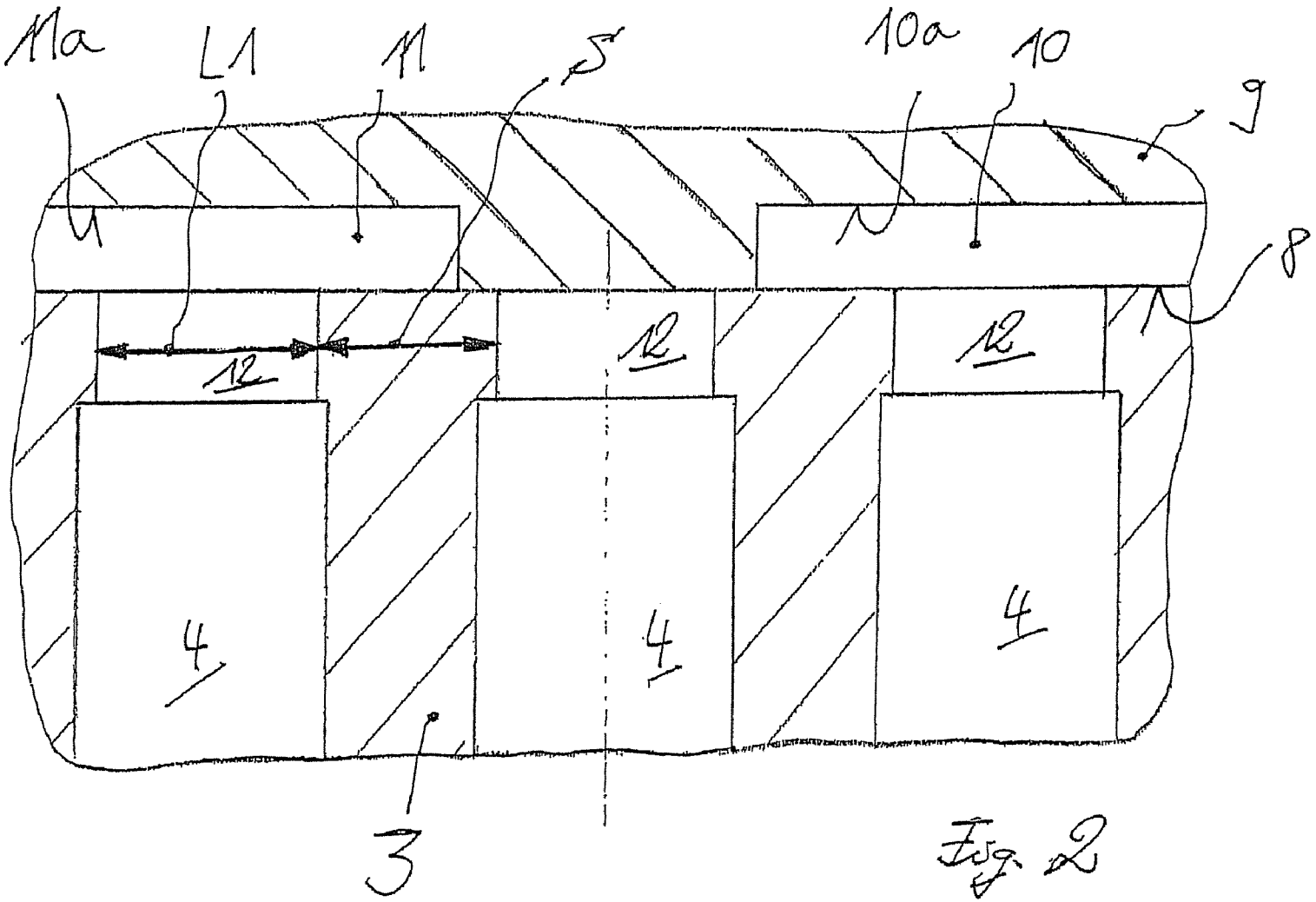
Fig. 2 (Prior Art)
FIG. 2 shows an enlarged section of the cylinder drum and the control surface illustrated in FIG. 1.

The connecting channels 12 (as shown in FIG. 2) thereby have a constant kidney-shaped cross-section with a length L1. Instead of a kidney-shaped cross-section of the connecting channels 12, the connecting channels can also be provided with a circular ring-shaped cross-section with a diameter L1.

Between the connecting channels 12 in the cylinder drum 3, a connecting web is realized, which for manufacturing reasons may not be less than a minimum width S.

During the operation of the axial piston machine 1, the cylinder drum 3 is pressed axially by a piston force toward the control surface 8. The pressing piston force is produced by the pressure that is present in the cylinder bore 4 and a pressurized surface area $A_K$. The cross-sectional area of the connecting channel 12 is thereby smaller than the cross-sectional area of the cylinder bore 4, whereby the difference forms the pressurized surface $A_K$. This pressing piston force counteracts a hydrostatic compressive force that is present in the gap between the cylinder drum 3 and the control surface 8. This pressure force results from the pressure that is present in the gap and a sealing web surface $A_E$, which is realized on the end side of the cylinder drum 3 that faces the control surface 8.

Figure 3:
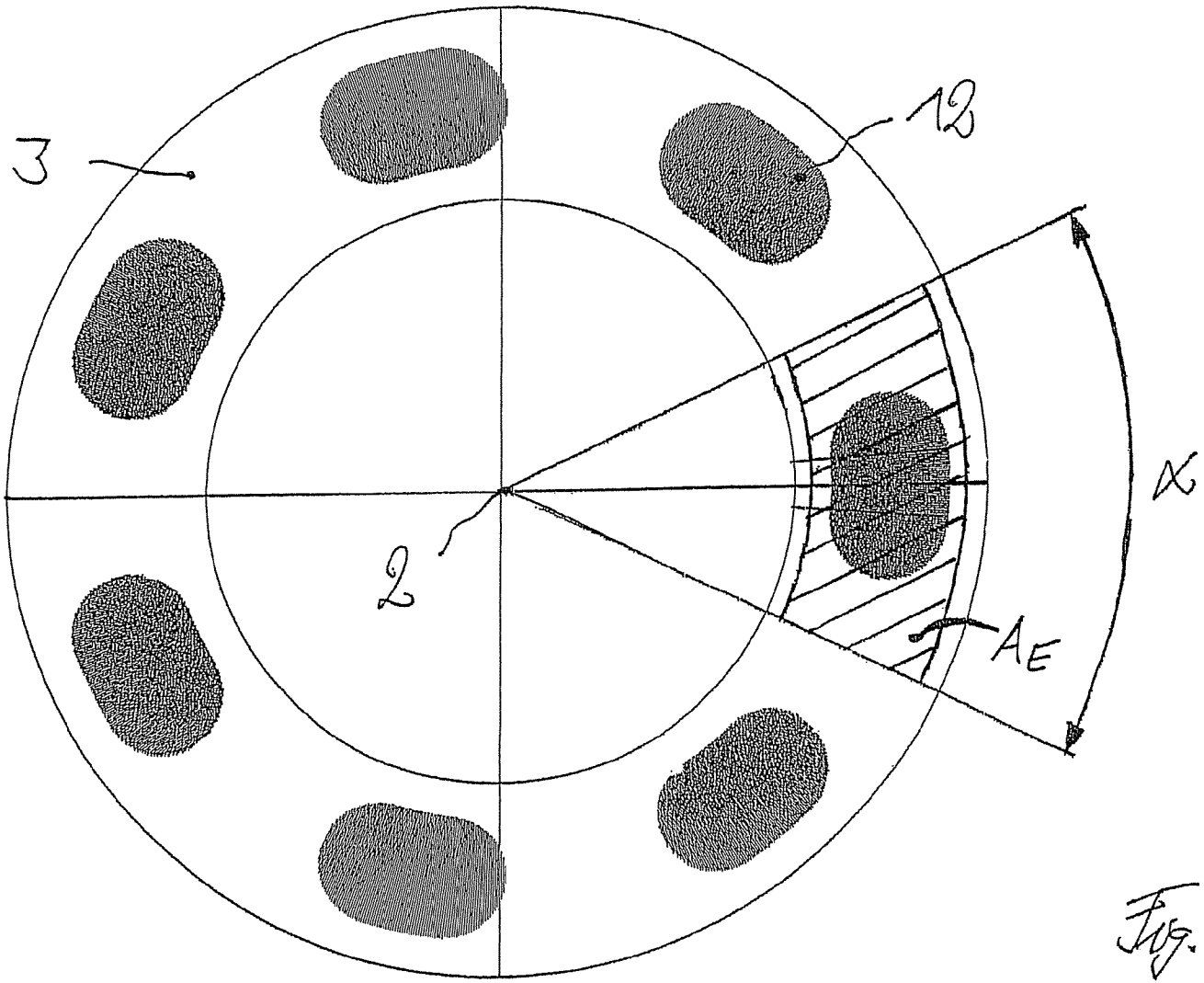
Fig. 3 (Prior Art)
FIG. 3 shows a plan view of the cylinder drum illustrated in FIG. 1.

FIG. 3 shows the sealing web surface $A_E$ that corresponds to a cylinder bore 4 and thus to one kidney-shaped connecting channel 12. The sealing web surface $A_E$ is bounded in the peripheral direction by a circular ring-shaped sector at the angular pitch $\alpha$ of the axial piston machine 1 and in the radial direction by inner and outer radial borders. The inner and outer radial borders of the sealing web surface $A_E$ are formed by the average diameter between the connecting opening 12 and the radial inner and radial outer boundary of the control surface 8.

Figure 4:
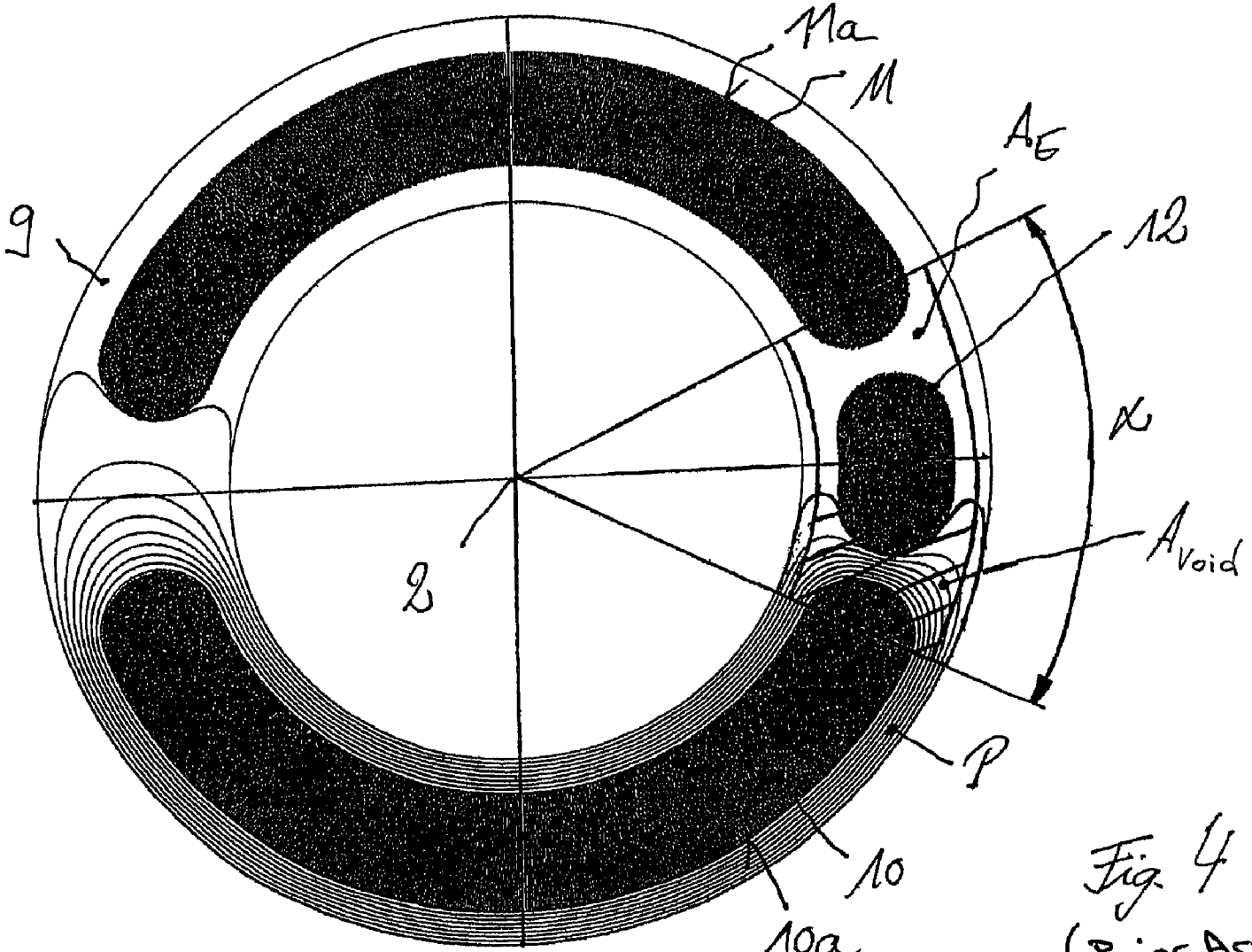
Fig. 4 (Prior Art)
FIG. 4 shows a plan view of the control surface illustrated in FIG. 1.

FIG. 4 shows a connecting channel 12 and thus a cylinder bore 4 during the reversal from the inlet connection 10 to the outlet connection 11 in the area of top dead center.

However, the sealing web surface $A_E$ associated with the connecting channel 12 is exposed to the disturbance effects described below during the reversal of the cylinder bores from the inlet connection 10 to the outlet connection 11 at top and bottom dead center.

If, as illustrated in FIG. 4, the inlet connection 10 forms the high-pressure side and the outlet connection 11 forms the low-pressure side of the axial piston machine 1, the connecting channel 12 and thus the associated cylinder bore 4, in the position shown in FIG. 4, has already been reversed to the outlet connection 11. The surface area $A_K$ on which the pressure is applied is therefore acted upon by the low pressure that is present at the outlet connection 11. As a result, there is a low piston force pressing the cylinder drum 3 on the control surface 8. However, the pressure field P that is present at the inlet connection 10 which forms the high pressure side, in the illustrated position of the connecting channel 12, projects into the sealing web surface $A_E$ that is associated with the connecting channel 12 and forms in the sealing web surface $A_E$ which is acted upon by the low pressure a void area $A_{void}$ which is acted upon by the high pressure which is present at the inlet connection 10. The void area $A_{Void}$ which is acted upon by the high pressure therefore leads to a high hydrostatic relieving compressive force. As a result, the cylinder drum 3 can lift up from the control surface 8 and an increased leak flow can occur at the gap between the cylinder drum 3 and the control surface 8, which leads to a reduction of the efficiency of the axial piston machine.

If, accordingly, the inlet connection 10 forms the low-pressure side and the outlet connection 11 forms the high-pressure side, in the position of the connecting channel 12 illustrated in FIG. 4, the associated cylinder bore 4 is acted upon by the high pressure that is present at the outlet connection 11. As a result, there is a high piston force pressing on the surface $A_K$. In this operating condition, again, the void area $A_{Void}$ which is formed by the pressure field P of the low pressure side, which is acted upon by the low pressure that is present at the inlet connection 10, projects into the sealing web surface $A_E$ of the associated connecting channel 12 formed by the high pressure. As a result, the relieving hydrostatic pressure force is reduced and the force that presses the cylinder drum 3 against the control surface 8 is increased. The result is increased wear and increased friction between the cylinder drum 3 and the control surface 8, which also leads to decreased efficiency of the axial piston machine.

Figure 5:
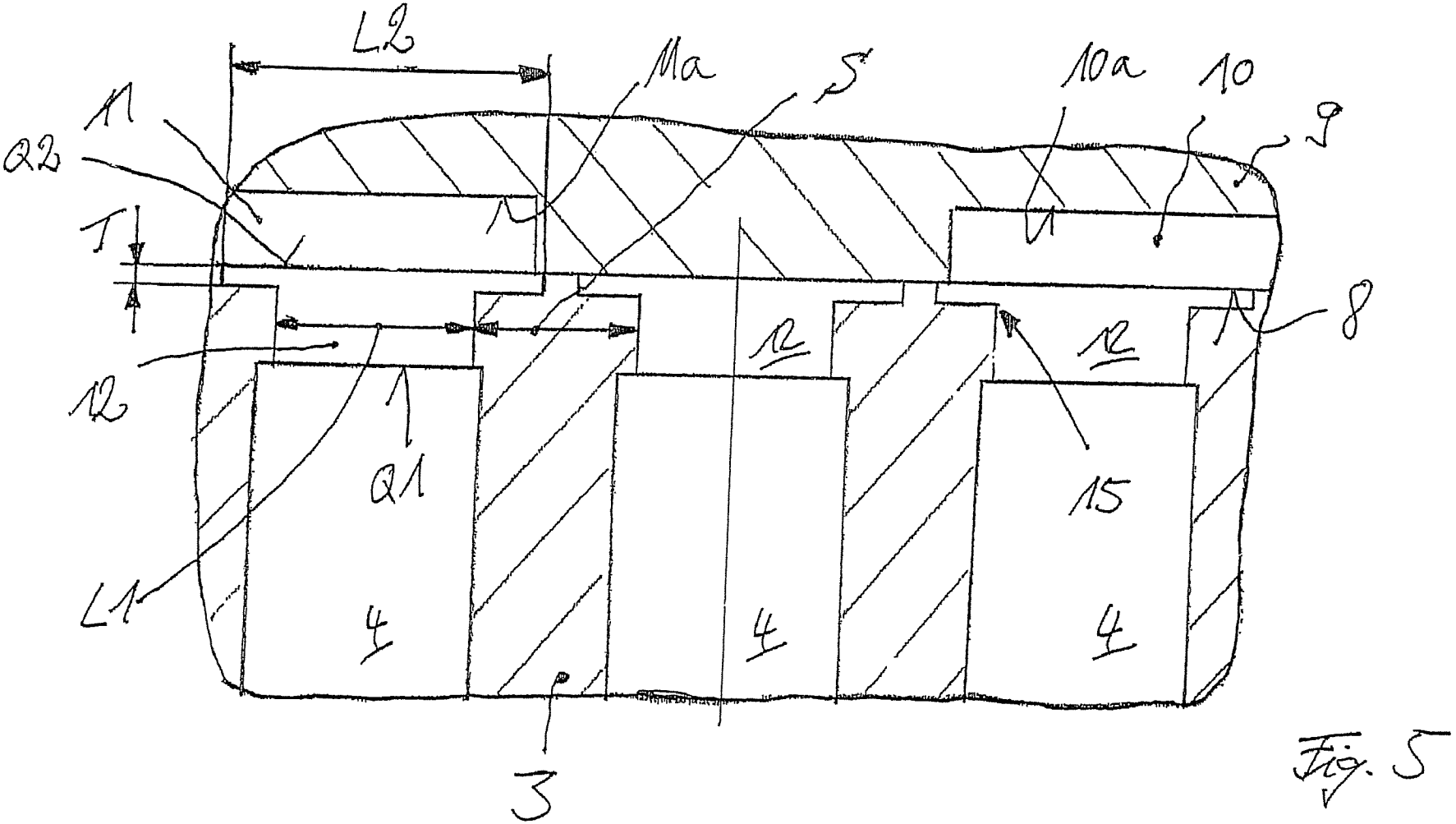
FIG. 5 shows a developed section of the cylinder drum and of the control surface of an axial piston machine of the invention.

The invention teaches that (as illustrated in FIG. 5), the connecting channels 12 that connect the corresponding cylinder bores 4 with the control surface 8 are provided with a cross-section that increases from the cylinder bore 4 to the control surface 8.

The connecting channels 12 thereby have a first cross-sectional area Q1, by means of which the connecting channels 12 are in connection with the cylinder bores 4, and a second cross-sectional area Q2 which is realized on the end surface of the cylinder drum 3, by means of which the connecting channels 12 are in communication with the control surface 8. The second cross-sectional area Q2 is larger than the first cross-sectional area Q1.

In the exemplary embodiment illustrated in FIG. 5, the first cross-sectional area Q1 and the second cross-sectional area Q2 are each provided with a kidney-shaped cross-section of the same width, whereby the length L2 of the second cross-sectional area Q2 is greater than the length L1 of the first cross-sectional area Q1.

The second cross-sectional area Q2 is thereby realized in the form of a depression of the connecting channel 12 on the end surface of the cylinder drum 3 that faces the control surface 8, whereby this depression is provided with a depth T. Consequently, the minimum width S of the connecting web of the cylinder drum 3 which is advantageous for strength reasons is preserved between the connecting channels 12.

The first cross-sectional area Q1 and the second cross-sectional area Q2 can thereby have equal widths. It is also possible, however, to give the second cross-sectional area Q2 a greater width than the first cross-sectional area Q1. In addition, instead of a kidney-shaped cross-section, the first and/or the second cross-sectional areas can be provided with a cross-section in the shape of a circular ring.

The transition 15 from the first cross-sectional area Q1 to the second cross-sectional area Q2 of the connecting channel 12 (as shown in FIG. 5 and in the exemplary embodiment on the right in FIG. 8) can be stepped.

Figure 8:
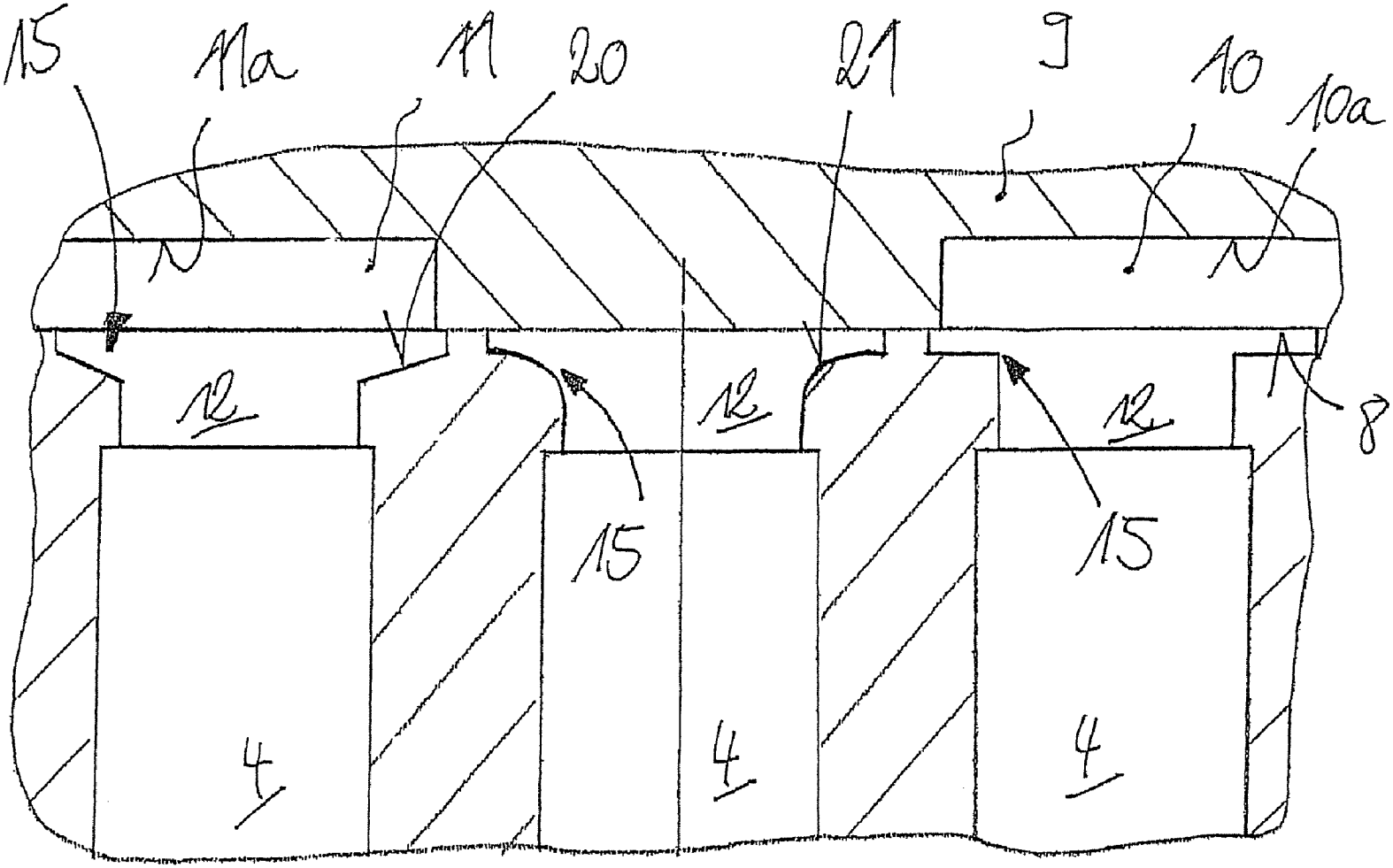
FIG. 8 shows an enlarged view of a portion of the cylinder drum and the control surface of an axial piston machine of the invention.

In addition, the transition 15 as shown in the exemplary embodiments of an axial piston machine of the invention illustrated on the left and in the center of FIG. 8 can be continuous. In the exemplary embodiment illustrated on the left in FIG. 8, the transition 15 can be formed by a slope 20 which results in a funnel-shaped transition 15, or as shown in the exemplary embodiment illustrated in the center in FIG. 8, the transition 15 can be realized with a convex profile 21.

Figure 6:
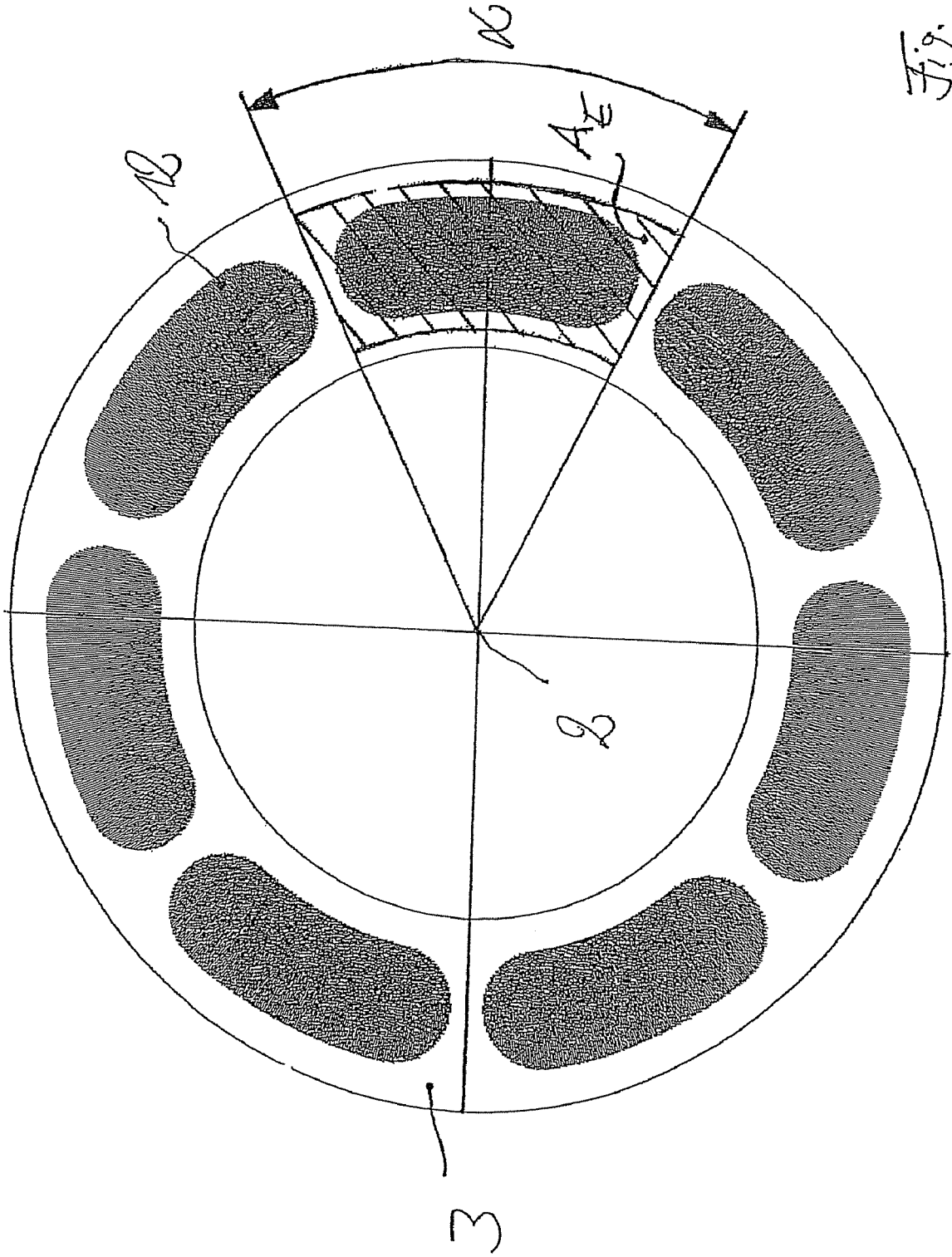
FIG. 6 shows a plan view of the cylinder drum illustrated in FIG. 5.
Figure 7:
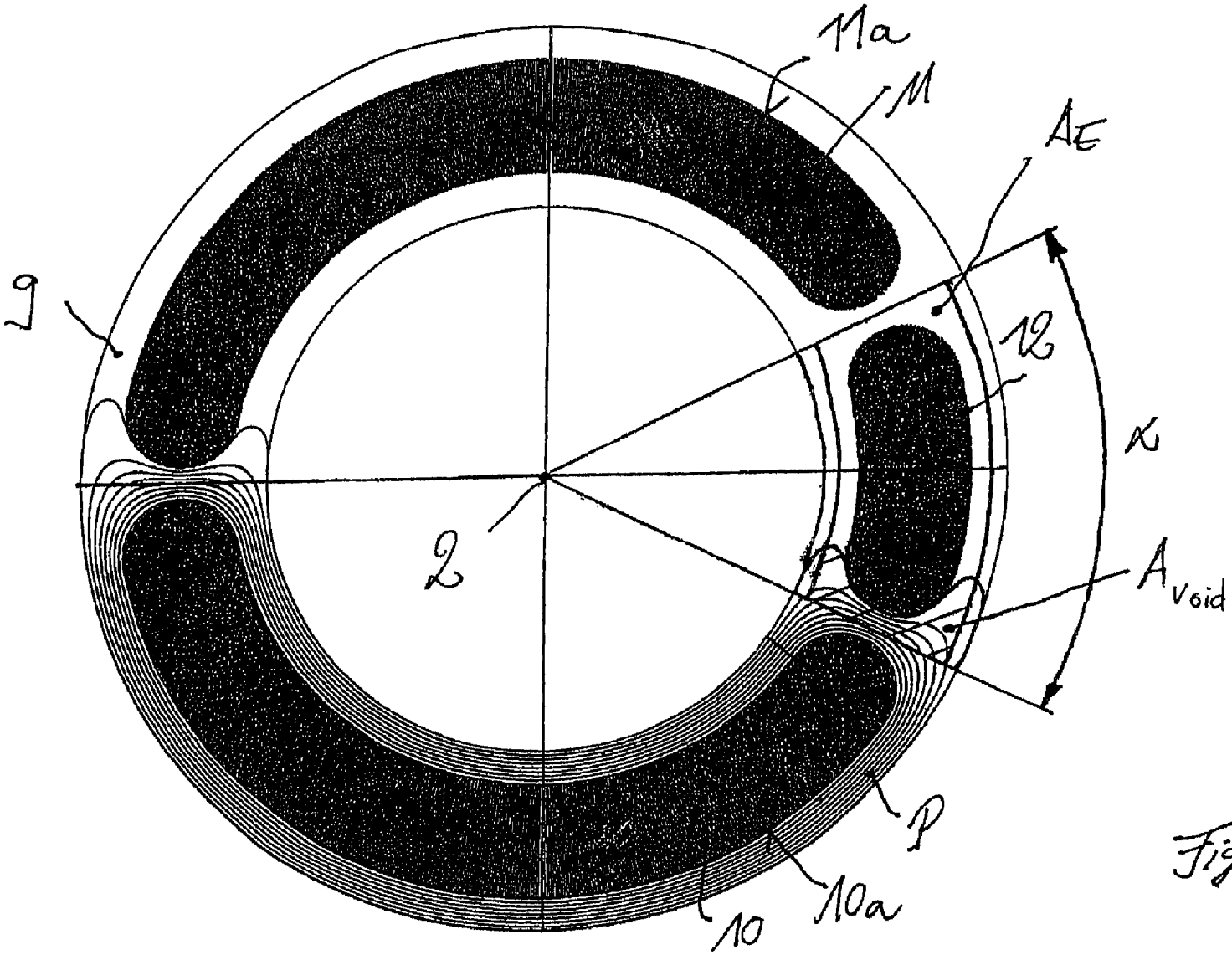
FIG. 7 shows a plan view of the control surface illustrated in FIG. 5.

As shown in FIG. 6, the length L2 of the second, kidney-shaped cross-sectional area Q2 extends over almost the entire surface $A_E$ of the sealing web that is associated with the cylinder bore 4. As illustrated in FIG. 7, it is apparent that on account of the larger second cross-sectional area Q2, during the reversal of the cylinder bore 4 from the inlet connection 10 to the outlet connection 11 in the area of the top and bottom dead centers, there is a smaller void area $A_{void}$ in the sealing web surface $A_E$ which is pressurized by the high pressure and low pressure.

If, during the reversal of the cylinder 4 from the inlet connection 10 which is acted upon by low pressure to the outlet connection 11 which is acted upon by high pressure, the sealing web surface $A_E$ is acted upon by the high pressure, and if the void area $A_{void}$ which is acted upon at low pressure projects into the sealing web surface $A_E$ which is acted upon by high pressure, as a result of the smaller size of the void area $A_{void}$, the result is a reduced additional pressing of the cylinder drum 3 by the piston force when the void area $A_{void}$ is acted upon by low pressure.

If, during the reversal of the cylinder bore 4 from the inlet connection 10 which is acted upon by high pressure to the outlet connection 11 which is acted upon by low pressure, the sealing web surface $A_E$ is acted upon by low pressure and if the void area $A_{void}$ which is acted upon by high pressure projects into the sealing web surface $A_E$ which is acted upon by low pressure, on account of the smaller size of the void area $A_{void}$ which is acted upon by high pressure, the gradient of the relieving pressure force when the void area $A_{void}$ is acted upon by high pressure is reduced.

Overall, therefore, the ratio of the pressing piston force to the relieving piston force is more constant. Therefore, as a result of the reduction of the disturbance effects, an axial piston machine of the invention has improved efficiency and reduced wear. Consequently, it becomes possible to use a less wear-resistant and therefore more economical material pair for the hydrostatic friction bearing that is formed by the cylinder drum 3 and the control surface 8.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic axial piston machine, comprising:

a cylinder drum rotatable around an axis of rotation, wherein the cylinder drum includes cylinder bores; and a piston mounted in each cylinder bore so that the piston is longitudinally disposable, wherein the cylinder drum is axially supported on a control surface that is affixed to a casing with the cylinder drum pressed towards the control surface by a piston force that is counteracted by a hydrostatic compressive force, wherein an inlet connection and an outlet connection are provided on the control surface, wherein the cylinder bores can each be brought into communication with the control surface by a connecting channel, wherein each connecting channel is provided with a cross-section that increases from the cylinder bore toward the control surface thereby reducing a sealing web surface of the hydrostatic compressive force, wherein the connecting channel is in communication by means of a first cross-sectional area with the cylinder bore and by a second cross-sectional area with the control surface, with the second cross-sectional area being larger than the first cross-sectional area, and wherein the first cross-sectional area and the second cross-sectional area are kidney-shaped, a width of the second cross-sectional area is substantially equal to a width of the first cross-sectional area and a length of the second cross-sectional area is greater than a length of the first cross-sectional area.

2. The hydrostatic axial piston machine as recited in claim 1, wherein the second cross-sectional area is in the form of a depression of the connecting channel on an end surface of the cylinder drum that faces the control surface.

3. The hydrostatic axial piston machine as recited in claim 1, wherein a transition from the first cross-sectional area to the second cross-sectional area is stepped.

4. The hydrostatic axial piston machine as recited in claim 1, wherein a transition from the first cross-sectional area to the second cross-sectional area is continuous.

5. The hydrostatic axial piston machine as recited in claim 4, wherein the transition from the first cross-sectional area to the second cross-sectional area is tapered.

6. The hydrostatic axial piston machine as recited in claim 4, wherein the transition from the first cross-sectional area to the second cross-sectional area is convex.

7. The hydrostatic axial piston machine as recited in claim 2, wherein a transition from the first cross-sectional area to the second cross-sectional area is stepped.

8. The hydrostatic axial piston machine as recited in claim 2, wherein a transition from the first cross-sectional area to the second cross-sectional area is continuous.

9. The hydrostatic axial piston machine as recited in claim 2, wherein the transition from the first cross-sectional area to the second cross-sectional area is tapered.

10. The hydrostatic axial piston machine as recited in claim 2, wherein the transition from the first cross-sectional area to the second cross-sectional area is convex.

11. A hydrostatic axial piston machine, comprising:

a cylinder drum rotatable around an axis of rotation, wherein the cylinder drum includes cylinder bores; and a piston mounted in each cylinder bore so that the piston is longitudinally disposable, wherein the cylinder drum is axially supported on a control surface that is affixed to a casing with the cylinder drum pressed towards the control surface by a piston force that is counteracted by a hydrostatic compressive force, wherein an inlet connection and an outlet connection are provided on the control surface, wherein the cylinder bores can each be brought into communication with the control surface by a connecting channel, wherein each connecting channel is provided with a cross-section that increases from the cylinder bore toward the control surface thereby reducing a sealing web surface of the hydrostatic compressive force, wherein the connecting channel is in communication by means of a first cross-sectional area with the cylinder bore and by a second cross-sectional area with the control surface, with the second cross-sectional area being larger than the first cross-sectional area, and wherein the second cross-sectional area has a kidney-shaped cross-section, with a width of the second cross-sectional area being substantially equal to a diameter of a first circular ring-shaped cross-section and a length of the second cross-sectional area is greater than a diameter of the first circular ring-shaped cross-section.

* * * * *